US008347762B2

(12) United States Patent
Jones

(10) Patent No.: US 8,347,762 B2
(45) Date of Patent: Jan. 8, 2013

(54) GLAD HAND WRENCH

(76) Inventor: Kenneth E. Jones, Baytown, TX (US)

( * ) Notice: Subject to any disclaimer, the term of this patent is extended or adjusted under 35 U.S.C. 154(b) by 169 days.

(21) Appl. No.: 12/792,453

(22) Filed: Jun. 2, 2010

(65) Prior Publication Data

US 2010/0307296 A1 Dec. 9, 2010

Related U.S. Application Data

(60) Provisional application No. 61/184,390, filed on Jun. 5, 2009.

(51) Int. Cl.
*B25B 13/06* (2006.01)
*B25B 13/48* (2006.01)
*B25B 13/50* (2006.01)

(52) U.S. Cl. ..... 81/121.1; 81/60; 81/124.6; 81/177.2

(58) Field of Classification Search ..... 81/121.1, 81/60, 124.6, 177.2, 124.2, 176.1–176.2, 81/901; D8/21–29; 70/14, 57, 237, 416, 70/163, 166–169; 285/62, 66–67, 70–72
See application file for complete search history.

(56) References Cited

U.S. PATENT DOCUMENTS

| | | | | |
|---|---|---|---|---|
| 4,226,103 | A | 10/1980 | Strickland | |
| D274,881 | S * | 7/1984 | Wilsey | D8/29 |
| 5,410,894 | A | 5/1995 | Fox et al. | |
| 5,988,569 | A | 11/1999 | Zhang et al. | |
| 6,120,064 | A | 9/2000 | McNamara | |
| 6,314,841 | B1 * | 11/2001 | Burk et al. | 81/125.1 |
| 6,609,445 | B2 * | 8/2003 | Elmore | 81/124.2 |
| 6,871,401 | B1 * | 3/2005 | Blankenship | 29/890.124 |
| 6,957,478 | B1 | 10/2005 | Ontiveros | |
| 7,637,183 | B2 * | 12/2009 | Alvarado | 81/120 |
| 2002/0078800 | A1 * | 6/2002 | Li | 81/177.2 |

* cited by examiner

*Primary Examiner* — Monica Carter
*Assistant Examiner* — Melanie Alexander
(74) *Attorney, Agent, or Firm* — Husch Blackwell LLP

(57) ABSTRACT

A device for engaging and rotating a glad hand. The device featuring a receptacle and an adaptor flange. The receptacle shaped to allow a glad hand to be seated therein. The receptacle formed by a base and at least one side wall extending from the base. The adaptor flange axially extending from an exterior surface of the base of the receptacle opposite the at least one side wall, the adaptor flange having a body, a central cavity and a open end opposite the base, the central cavity of the adaptor flange extending longitudinally within at least part of the body from the open end.

18 Claims, 2 Drawing Sheets

GLAD HAND WRENCH

CROSS REFERENCE TO RELATED APPLICATION

This application claims the benefit of U.S. Provisional Application Ser. No. 61/184,390 filed Jun. 5, 2009 entitled "Simplified Wrench." The entirety of this application is incorporated by reference as if fully set forth herein.

FIELD OF THE INVENTION

Embodiments of the subject invention are directed to an improved wrench, and more particularly to a wrench suitable for engaging and rotating glad hands used on tractor-trailer air brake systems.

BACKGROUND OF THE INVENTION

Semi-trailer trucks almost universally utilize pneumatic air brake systems. Such air brake systems typically require air lines or hoses on both the tractor and trailer units. These air lines are coupled together in order create a pressurized system that enables the operator to actuate the brakes of the trailer together with those on the tractor unit. Ordinarily, these air hoses are coupled together by so called "glad hand" connectors. Glad hands are coupling devices used to connect the service and emergency air lines from the truck or tractor to the trailer. The couplers have a rubber seal which prevents air from escaping. To connect the glad hands, the two seals are pressed together with the couplers at a 90° angle to each other. A turn of the glad hand attached to the hose will join and lock the couplers. A glad hand connector typically features two substantially identical glad hands. Generally, one glad hand is rigidly connected to the frame of the trailer and the other is connected to an air hose extending from the tractor's pneumatic brake system.

Glad hands typically comprise a disk shaped housing having a curved edge, an engaging tab extending from one side of the housing and a support member extending from the other end of the housing opposite the engaging tab. Generally, the support member features a retaining tab extending adjacent the housing. To mate two glad hands together, the housings are placed together, and one or both of the units are rotated until the engaging tab of each glad hand slides between the housing and the retaining tab of the other glad hand. In this position, the glad hands are securely and engagingly held together.

When the two glad hands are connected, a leak-free path exists between the air hoses of the tractor and trailer, so that high air pressure (typically 90 to 120 pounds per square inch) is maintained within the lines of both the tractor and trailer units. The brake system of the trailer is designed so that the trailer's brakes are in the fully applied state when there is no air pressure in the trailer brake lines (that is, the brakes are partially or fully engaged by partial or full release of such air pressure in the brake system). Consequently, a trailer cannot be operatively moved until the glad hand of the trailer is coupled with the glad hand of a tractor. In addition, if the glad hands are pulled apart from one another, as may happen when the tractor and trailer are separated without first uncoupling the air lines, the glad hands are designed to separate from one another without damaging the air hoses of the tractor or trailer.

In ordinary operation, such as for maintenance, it occasionally becomes necessary to remove a glad hand from the chassis of the trailer bulkhead. Previous methods for removing glad hands from the chassis of the trailer bulkhead involve using common wrenches such as a Crescent® or adjustable spanner wrench or a pipe wrench. Previous glad hand removal methods have been found to have several disadvantages. For example, glad hands are often damaged during removal as a consequence of using previous removal methods. Glad hands are designed to efficiently mate with each other, but they are not designed to handle the twisting force exerted by a Crescent® wrench or a pipe wrench used during removal. The glad hand, being typically made of cast aluminum or other like metal, is prone to cracking under the torque force of a Crescent® wrench or a pipe wrench. As explained in more detail below, the configuration of the trailer bulkhead in which the glad hand is installed, often limits the angle from which a Crescent® wrench or a pipe wrench can access the glad hand. The torque force applied by such wrenches, combined with a non-ideal torque angle can result in too much strain, and ultimately can cause stress fractures and cracks in the glad hand.

It is common in normal operation for glad hands to be affixed to the chassis of the trailer in a recessed portion of the trailer bulkhead. The recessed portion of the trailer bulkhead allows access to the glad hand by the glad hand coupler which is connected to the air hose of the trailer air brake system. The glad hand on the chassis may be accessed by the air hose of the trailer brake system. However, the recessed portion of the trailer bulkhead often restricts access to the glad hand mounted on the chassis. Specifically, the use of common wrenches is disadvantageous due to the limited space of the recessed portion of the trailer bulkhead in which the glad hand is located. The limited space restricts range of motion required by common wrenches, and also makes it difficult, if not impossible, to generate the torque required to disengage the glad hand from the trailer bulkhead.

There is therefore a continuing need for a cost effective device that can provide an improved means for engaging and rotating a glad hand while reducing the risk of damage. There is additionally a need for a glad hand removal tool that can be utilized to engage and rotate a glad hand within restricted or confined area such as trailer bulkhead.

SUMMARY OF THE INVENTION

In accordance with the present invention an improved device, or wrench, suitable for engaging and rotating a glad hand is provided. The device, or wrench, comprises a receptacle formed by at least one side wall and an adaptor flange. The receptacle has an open end, a closed end and is shaped to allow a glad hand to be seated therein. The adaptor flange axially extends from an exterior surface of the base. The adaptor flange has a body, a central cavity and an open end opposite the base, the central cavity of the adaptor flange extends longitudinally within at least part of the body from the open end.

According to various embodiments, the receptacle can have at least one generally rigid tongue-shaped element extending beyond the open end. The tongue-shaped element can feature a tip opposite the base of the receptacle. The tip of the tongue-shaped element can feature a laterally tapering edge such that the tip's width narrows as it extends away from the base.

Additional embodiments can feature a ratchet wrench and one or more drive extension units. In one embodiment, the ratchet wrench features a ratchet head having a drive shaft and an arm longitudinally extending from the head. The drive shaft is suitable for engaging the central cavity of the adaptor flange or a central cavity of one of the drive extensions. The one or more drive extension units can generally feature a first end having a drive shaft suitable for engaging the central cavity of the adaptor flange or a central cavity of another extension unit, and a second end having a recess forming a cavity. The cavity of the drive extension unit is generally suitable for receiving the drive shaft of the ratchet wrench or a drive shaft of another extension unit.

When fully engaged with a glad hand, the receptacle extends over at least a portion of the glad hand. In this position, the receptacle provides a suitable contact interface such that the glad hand can be rotated about a threaded glad hand coupling without placing excess stress on any particular portion of the glad hand. In other words, the receptacle provides increased surface area over which the glad hand is engaged. This increased surface contact with the glad hand reduces the surface pressure on any single point, and distributes the torque force evenly over the surface of the glad hand. Distribution of the torque force tends to reduce the chance of damaging the glad hand upon its application or removal from the glad hand coupling.

Another advantage is the improved safety protections from injury to the user during glad hand removal. Previous methods of glad hand removal using common wrenches often require the user to reach within the trailer bulkhead while simultaneously applying the torque force necessary to remove the glad hand. This technique has the disadvantage that the wrench often slips or suddenly releases once the glad hand releases from the chassis. Such sudden, uncontrolled motion such as described above can result in significant harm to the user's hand or arm if it strikes the trailer chassis, bulkhead or any other surface. Thus, the present invention has the advantage of enabling a user to safely operate the device from an area outside of the trailer bulkhead, thereby significantly reducing the chance of injury during removal of the glad hand.

A further advantage is that the device has the ability to engage glad hands of varying sizes and dimensions. While most glad hand connectors are generally constructed such that they may universally engage with all other tractor-trailer glad hands, not all are constructed to exactly the same dimensions. The device of the present invention is constructed such that it can provide a secure engagement with glad hands within a known range of varying dimensions.

Additionally, embodiments of the present invention can further be used to engage exhaust valve glad hands used with tractor trailer air brake systems. Exhaust valve glad hands are part of air brake systems and provide added breaking efficiency and utility to tractor-trailer brake systems. Exhaust valve glad hands are substantially similar in operation to standard glad hands as described above. The primary difference is that an exhaust valve glad hand is typically a different size than the standard glad hand. It is contemplated that embodiments of the present invention can include alternate dimensions suited for use with both standard glad hands and also exhaust valve glad hands.

Further objects, features and advantages of the present invention will be apparent from the following description and the appended claims when taken in conjunction with the accompanying drawings.

DETAILED DESCRIPTION

Figure 1:
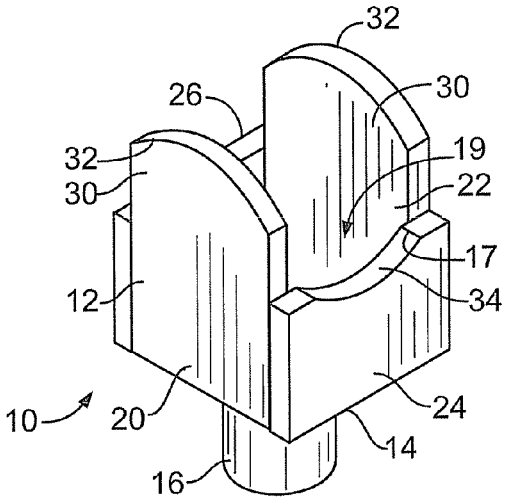
FIG. 1 is a perspective view of a device made in accordance with the teachings of the present invention.

While the present invention is susceptible of embodiment in various forms, there is shown in the drawings a number of presently preferred embodiments that are discussed in greater detail hereafter. It should be understood that the present disclosure is to be considered as an exemplification of the present invention, and is not intended to limit the invention to the specific embodiments illustrated. It should be further understood that the title of this section of this application ("Detailed Description") relates to a requirement of the United States Patent Office, and should not be found to limit the subject matter disclosed herein.

In this disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

Referring now to the figures, and specifically to FIGS. 1 and 2*a* through 2*c*, there is shown a device 10 featuring a receptacle 12 formed by a base 14 and at least one side wall 20, 22, 24, 26 extending from the base 14. The receptacle 12 can additional have an open end 17 opposite the base and centrally-located cavity 19. As shown in the figures, the device 10, according to various embodiments, can have first and second opposing side walls 20, 22. The first and second side walls 20, 22 can extend generally perpendicularly from the base 14 and be substantially parallel to one another. The receptacle can be formed from a durable rigid material such as, for example, machine welded steel, aluminum, titanium, graphite, stainless steel, or polycarbonate or any other materials having similar properties. The receptacle can additionally be shaped in any manner that allows a glad hand to be seated therein.

FIG. 1 shows the side walls 20, 22, 24, 26 forming a generally rectangular shaped receptacle 12 having a generally cube-shaped cavity 19. Persons having ordinary skill in the art will understand that the receptacle 12 and central cavity 19 can be made to have other shapes. Moreover, it will be further understood that, while various parts shown in the figures have been described and illustrated as having certain shapes, sizes or configurations, these representations are merely given for ease of understanding, and thus the shapes, sizes and proportions of any parts can be modified in order to accomplish the described functions without departing from the novel scope of the present invention.

Figure 2A:
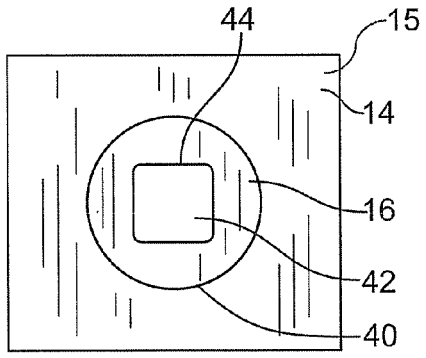
FIG. 2A is a plan view of the device of FIG. 1.
Figure 2B:
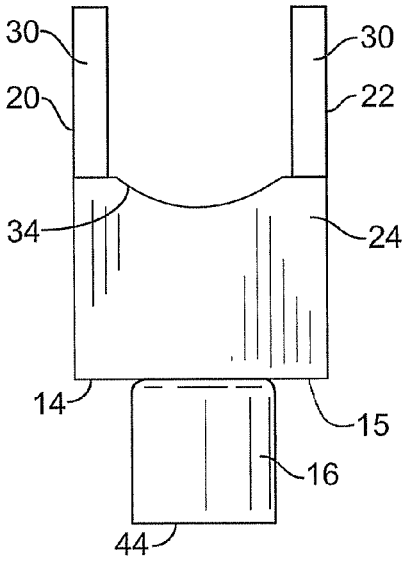
FIG. 2B is an elevation view of the device of FIG. 1.
Figure 2C:
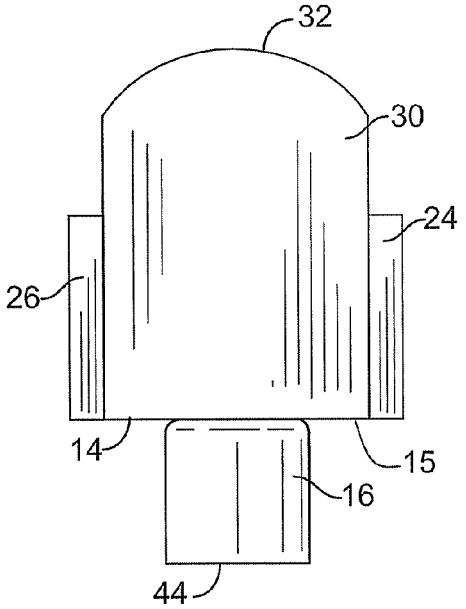
FIG. 2C is an alternate elevation view of the device of FIG. 1.
Figure 3:
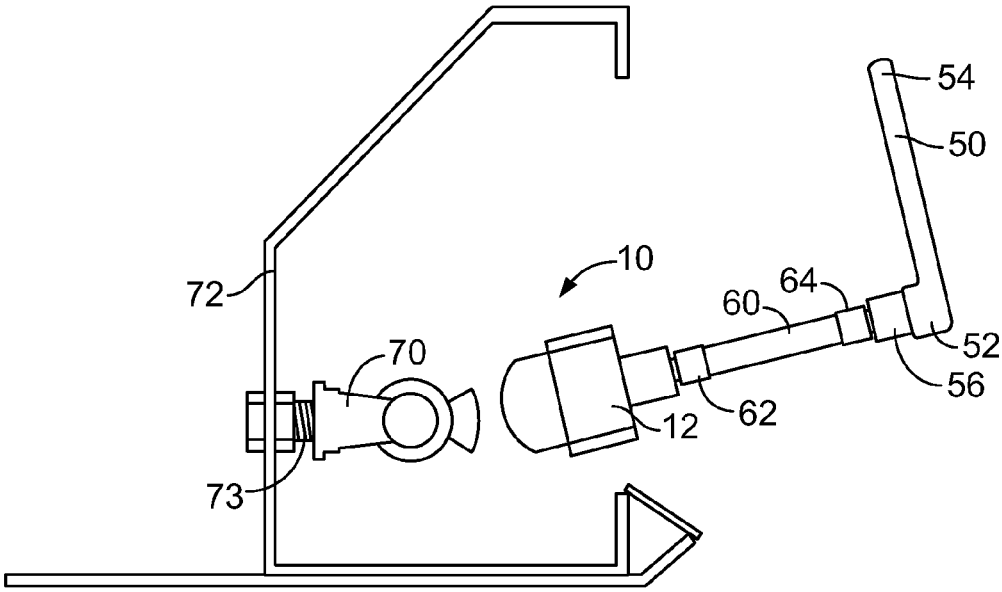
FIG. 3 is an elevation view of a device of the present invention shown engaging a glad hand affixed to a trailer bulkhead.

As shown in FIGS. 1-3, the receptacle can have at least one generally rigid tongue-shaped element 30 extending beyond the open end 17. The tongue-shaped element 30 can have a tip 32 opposite the base 14. As shown in FIGS. 1 and 2*c*, the tip 32 can have an edge that laterally tapers such that the width of the tip 32 narrows as it extends away from the base 14. However, it will be understood by persons of ordinary skill in the art that the tip 32 can have different shapes without departing from the novel scope of the present invention. Moreover, while the figures show the tongue-shaped elements 30 of the first and second side walls 20, 22 to have a substantially equal length from the open end 17 to the tip 32, it will be understood that the tongue-shaped element 30 of either side wall could be longer than the other.

Referring again to FIGS. 1-3, the device 10 additionally features an adaptor flange 16 axially extending from an exterior surface 15 of the base 14. Adaptor flange 16 can have a body 40, a central cavity 42 and an open end 44 opposite the base 14. While, FIG. 2 shows the body 40 having a cylindrical shape and a particular length, the body 40 can be alternately shaped and can have various lengths adapted to suit variety of different applications. The central cavity 42 of the adaptor flange 16 can extend longitudinally within the body 40 from the open end 44 and can be suitable for receiving a drive shaft. The central cavity of the adaptor flange can be sized to accommodate any size drive shaft, such as, for example a ½ inch size drive shaft.

The receptacle 12 can have third and fourth opposing side walls 24, 26 extending from the base 14. The third and fourth side walls 24, 26 can be extend substantially perpendicular from the base and be substantially parallel to each other. According to various embodiments, the third and fourth side walls 24, 26 can feature an inwardly bowed edge 34 at the open end 17 of the receptacle 12. As shown in FIGS. 1 and 2*b*, the inwardly bowed edge 34 of various embodiments can have an arcuate formation and curve inward towards the base 14. It will be understood that the inwardly bowed edge can be alternatively sized or shaped. Moreover, persons of ordinary skill in the art will further understand that according to various embodiments, the third and fourth side walls 24, 26 can have a generally straight edge, or any alternative configuration having similar properties, at the open end 17 of the receptacle 12.

Figure 4:
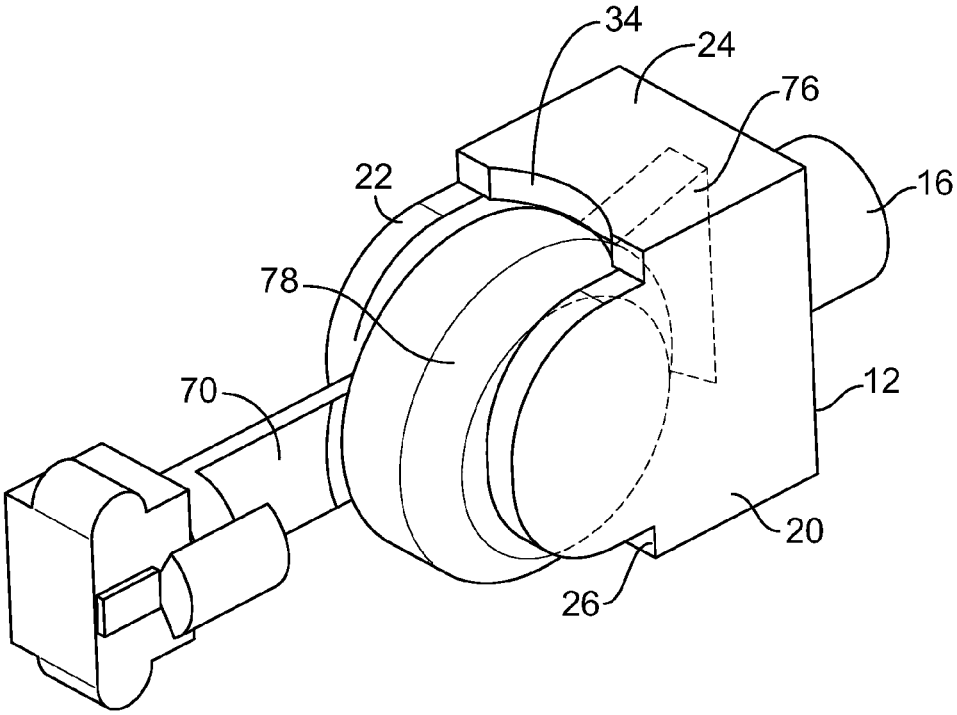
FIG. 4 is a perspective view of the device of FIG. 3 engaging a glad hand; the phantom lines giving an indication of the placement of the device relative to the glad hand.

As shown in FIGS. 3 and 4, the device, or wrench 10 is suitable for engaging and rotating a glad hand 70. In particular, FIG. 3 shows the device 10 engaging a glad hand affixed to a trailer bulkhead 72. According to this embodiment, the device 10 features a ratchet wrench 50 and one or more drive extension units 60 coupled to the receptacle 12. The ratchet wrench 50 having a head 52 featuring a drive shaft 56 and an arm 54 longitudinally extending from the head 52. The arm of the ratchet wrench 50 being suitable to provide the user with appropriate leverage to engage and rotate the glad hand 70 around a threaded glad hand coupling 73.

It will be seen that the one or more drive extension units 60 can have an elongated length having first and second ends 62, 64. The extension units 60 providing increased length to the drive shaft 56 to enable the device 10 to engage a glad hand 70 in a confined area such as the trailer bulkhead 72. The first end 62 of an arm extension unit 60 having a drive shaft suitable for engaging the central cavity 42 of the adaptor flange 16. The second end 64 of an extension unit 60 having a recess forming an interior cavity suitable for receiving the drive shaft 56 of the ratchet wrench 50 or the drive shaft of another extension unit 60. It will be understood that, according to various embodiments, the device 10 can be sized to be used without the one or more extension units 60. According to these embodiments, the drive shaft 56 of the ratchet wrench 50 will directly engage the central cavity 42 of the adaptor flange 16. In addition, the body 40 of the adaptor flange 16 can be lengthened so that one or more extension units 60 are not necessary in order to use the device 10 in confined areas.

FIG. 4 shows the device 10 fully engaged with a glad hand 70. When fully engaged, the first and second side walls 20, 22 of the receptacle 12 extend over the glad hand 70 so that the engaging tab 76 of the glad hand and at least part of the disk shaped housing 78 are within the central cavity of the receptacle 12. In this position, the edges of the glad hand's disk shaped housing 78 can be flush against the third and fourth side walls 24, 26 such that the receptacle 12 provides a suitable contact interface and the glad hand 70 can be rotated about a connection point without placing excessive stress on any particular portion of the glad hand. By engaging the glad hand 70 in this manner, the receptacle 12 provides increased surface area over which the glad hand 70 is engaged. This increased surface contact with the glad hand 70 reduces the surface pressure on any single point, and distributes the torque force evenly over the entire surface of the glad hand 70. Distribution of the torque force tends to reduce the chance of damaging the glad hand 70 upon its application or removal.

Because glad hand connectors are not always the same shape, size or dimension, it is contemplated that embodiments of the present invention can use of the device 10 with varying couplings of alternative dimensions or configurations. In addition, while the embodiments described and illustrated herein reference use of the device 10 in connection with glad hands, the claimed embodiments are not limited to such and thus can be used to rotate or engage alternative couplings, connectors, fasteners or similar devices.

The present disclosure includes that which is contained in the appended claims, as well as that of the forgoing description. Although, this invention has been described in its preferred form with a certain degree of particularity, it is understood that the present disclosure of the preferred form has been made only by way of example, and that numerous changes in the details of the elements, compositions and the combination of individual ingredients may be resorted to without departing from the novel spirit or scope of the invention.

What is claimed is:

1. A device for engaging a glad hand, comprising:

a receptacle shaped to allow a glad hand to be seated therein, the receptacle formed by a base and a plurality of side walls extending from the base, the receptacle having an open end opposite the base, the plurality of side walls having opposing first and second side walls and opposing third and fourth side walls, the first and second side walls having a generally rigid tongue-shaped element extending beyond the open end of the receptacle, the tongue-shaped element having a tip opposite the base of the receptacle, the tip having a laterally tapering edge such that the tip's width narrows as it extends away from the base, the third and fourth side walls having an inwardly bowed edge at the open end of the receptacle, the bowed edge having an arcuate shape curving towards the base, the tongue-shaped element integrally extending from the first and second side walls beyond the third and fourth side walls at the open end of the receptacle, the first and second side walls extending a greater distance away from the base than the third and fourth side walls; and an adaptor flange axially extending from an exterior surface of the base of the receptacle opposite the plurality of side walls, the adaptor flange having a body, a central cavity and an open end opposite the base, the central cavity of the adaptor flange extending longitudinally within at least part of the body from the open end, the central cavity suitable for receiving a drive shaft.

2. The device of claim 1 further comprising a ratchet wrench having a head and an arm longitudinally extending from the head, the head having a drive shaft suitable for engaging the central cavity of the adaptor flange.

3. The device of claim 2 further comprising at least one drive extension unit having a first and second end, the first end of the at least one extension unit having a drive shaft suitable for engaging the central cavity of the adaptor flange, the second end of the at least one extension unit having a recess forming an interior cavity for receiving a drive shaft.

4. The device of claim 1, wherein the central cavity of the adaptor flange is suitable for receiving a ½ inch size drive shaft.

5. The device of claim 1, wherein the receptacle is formed from machine welded steel.

6. The device of claim 1, wherein the tongue-shaped element of the first side wall has a substantially equal length to the tongue-shaped element of the second side wall.

7. The device of claim 1, wherein the receptacle has a rectangular shape in cross-section.

8. A device for engaging a glad hand, comprising:

a receptacle shaped to allow a glad hand to be seated therein, the receptacle formed by a base and a plurality of side-walls extending from the base, the receptacle having an open end opposite the base, the plurality of side walls comprising first and second opposing side walls and third and fourth opposing side walls, the first and second side walls each having a generally rigid tongue-shaped element extending beyond the open end of the receptacle, the tongue-shaped element integrally extending from the first and second side walls beyond the third and fourth side walls at the open end of the receptacle, the tongue-shaped element having a tip opposite the base of the receptacle, the tip having a laterally tapering edge such that the tip's width narrows as it extends away from the base, the first and second side walls extending a greater distance away from the base than the third and fourth side walls; and an adaptor flange axially extending from an exterior surface of the base of the receptacle opposite the side walls, the adaptor flange having a body, a central cavity and an open end opposite the base, the central cavity of the adaptor flange extending longitudinally within the body from the open end and having a rectangular shape in cross-section, the central cavity suitable for receiving a drive shaft.

9. The device of claim 8, wherein the opposing third and fourth side walls each have an inwardly bowed edge at the open end of the receptacle, the bowed edge having an arcuate shape extending towards the base of the receptacle.

10. The device of claim 8, wherein the receptacle has a rectangular shape in cross-section.

11. The device of claim 8, wherein the tongue-shaped element of the first side wall has a substantially equal length to the tongue-shaped element of the second side wall.

12. The device of claim 8, wherein the central cavity of the adaptor flange is suitable for receiving a ½ inch size drive shaft.

13. The device of claim 8, wherein the receptacle is formed from machine welded steel.

14. The device of claim 8 further comprising a ratchet wrench having a head and an arm longitudinally extending from the head, the head having a drive shaft suitable for engaging the central cavity of the adaptor flange.

15. The device of claim 14 further comprising at least one drive extension unit having a first and second end, the first end of the at least one extension unit having a drive shaft suitable for engaging the central cavity of the adaptor flange, the second end of the at least one extension unit having a recess forming an interior cavity for receiving a drive shaft.

16. A device for engaging a glad hand, the device comprising a receptacle to allow a glad hand to be seated therein, the receptacle formed by a base and a plurality of side-walls extending from the base, the receptacle having an open end opposite the base and a generally rectangular shape in cross-section, the plurality of side walls comprising first and second opposing side walls, the first and second side walls each having a generally rigid tongue-shaped element extending beyond the open end of the receptacle, the tongue-shaped element of the first side wall having a substantially equal length to the tongue-shaped element of the second side wall, the tongue-shaped element of the first and second side walls having a tip opposite the base of the receptacle, the tip having an laterally tapering edge such that the tip's width narrows as it extends away from the base, the plurality of side walls comprising third and fourth opposing side walls, the third and fourth side walls each have an inwardly bowed edge at the open end of the receptacle, the bowed edge having an arcuate shape extending towards the base of the receptacle, the tongue-shaped element integrally extending from the first and second side walls beyond the third and fourth side walls at the open end of the receptacle, the first and second side walls extending a greater distance away from the base than the third and fourth side walls;

an adaptor flange axially extending from an exterior surface of the base of the receptacle opposite the side walls, the adaptor flange having a body, a central cavity and an open end opposite the base, the central cavity of the adaptor flange extending longitudinally within at least a portion of the body from the open end, the cavity having a rectangular shape in cross section, the central cavity suitable for receiving a drive shaft;

a ratchet wrench having a head and an arm longitudinally extending from the head, the head having a drive shaft extending therefrom; and at least one drive extension unit having a first and second end, the first end of the at least one extension unit having a drive shaft suitable for engaging the central cavity of the adaptor flange, the second end of the at least one extension unit having a recess forming an interior cavity.

17. The device of claim 16, wherein the central cavity of the adaptor flange is suitable for receiving a ½ inch size drive shaft.

18. The device of claim 16, wherein the receptacle is formed from machine welded steel.

* * * * *